United States Patent [19]

Tomita et al.

[11] Patent Number: 4,490,574

[45] Date of Patent: Dec. 25, 1984

[54] ELECTRICAL CABLE

[75] Inventors: Akira Tomita, Yamato; Kunitada Tominoi, Kawasaki, both of Japan

[73] Assignee: AMP Incorporated, Harrisburg, Pa.

[21] Appl. No.: 561,129

[22] Filed: Dec. 13, 1983

Related U.S. Application Data

[63] Continuation of Ser. No. 383,638, Jun. 1, 1982, abandoned.

[30] Foreign Application Priority Data

Jun. 18, 1981 [GB] United Kingdom ..... 8118727

[51] Int. Cl.[3] ..... H01B 7/08; H01B 11/18

[52] U.S. Cl. ..... 174/36; 174/115; 174/117 F

[58] Field of Search ..... 174/36, 115, 117 F

[56] References Cited

U.S. PATENT DOCUMENTS

| | | | |
|---|---|---|---|
| 2,043,044 | 6/1936 | Knoderer | 174/115 |
| 3,775,552 | 11/1973 | Schumacher | 174/105 R |
| 4,218,581 | 8/1980 | Suzuki | 174/36 |
| 4,234,759 | 11/1980 | Harlow | 174/117 F |
| 4,374,299 | 2/1983 | Kincaid | 174/36 |
| 4,383,725 | 5/1983 | Bogese et al. | 174/36 |
| 4,412,092 | 10/1983 | Hansell | 174/36 |

FOREIGN PATENT DOCUMENTS 697919 11/1964 Canada ..... 173/13

OTHER PUBLICATIONS

Schinko, Herwig; "Flat Cables as Transmission Elements for Digital Systems"; Siemens Review LXII (1975), No. 3.

*Primary Examiner*—John F. Gonzales
*Assistant Examiner*—Morris H. Nimmo
*Attorney, Agent, or Firm*—Adrian J. LaRue

[57] ABSTRACT

According to the present invention, a shielded electrical cable comprises an outer layer of insulating material surrounding a signal conductor and an associated ground conductor and a common shielding layer in electrical contact with the ground conductor but separated from the signal conductor by an inner layer of insulating material surrounding the signal conductor, the signal and ground conductors extend in spaced parallel relationship in a common plane, each surrounded by an individual outer layer of insulating material, the two outer layers of insulating material being integrally formed with a web extending between the two outer layers of insulating material, the shielding layer extending about the inner layer of insulating material on the signal conductor, through the web, and about the ground conductor.

8 Claims, 3 Drawing Figures

FIG.1.
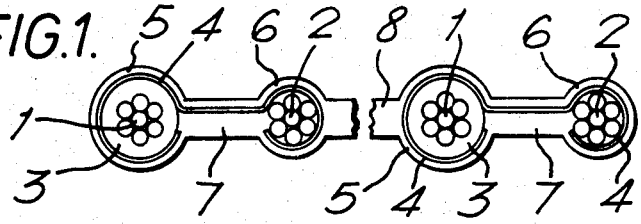
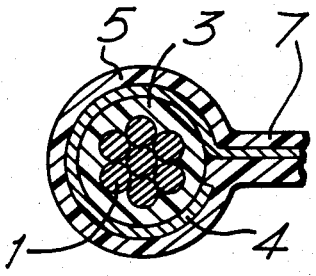
FIG.2.
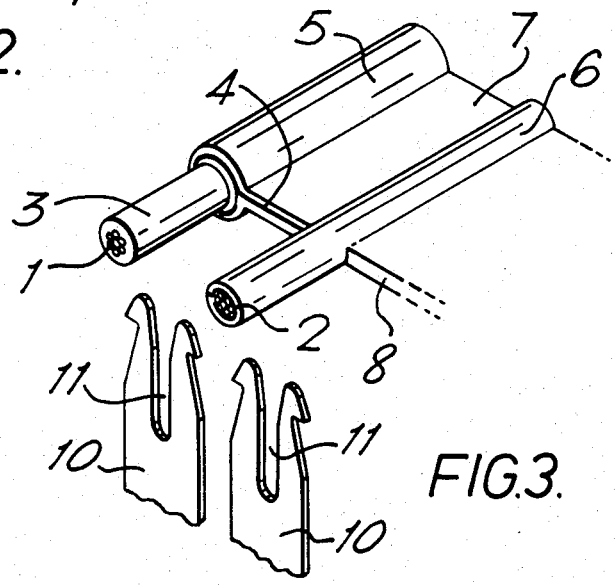
FIG.3.

ELECTRICAL CABLE

This application is a continuation of application Ser. No. 383,638 filed June 1, 1982 abandoned.

BACKGROUND OF THE INVENTION

1. Field of the Invention

This invention relates to an electrical cable more particularly to a shielded electrical cable.

Coaxial electrical cables are well known, such cables generally being terminated by the use of electrical connectors having coaxial conductive members separated by dielectric material.

Also known are shielded electrical cables comprising one or more insulated signal conductors surrounded by a shielding layer formed, for example, by a metal foil. To facilitate termination of such cable a further uninsulated conductor is sometimes provided between the shielding layer and the insulation of the signal conductor or conductors, termination of this further conductor constituting termination of the shielding layer.

Both these known forms of cable normally require the use of specifically designed connectors for termination, these connectors not being suitable for the use of mass termination techniques, that is the simultaneous connection of a plurality of conductors to individual contacts in a connector, but requiring individual attention. This is a particular problem with composite cables comprising a plurality of pairs of associated conductors arranged in a planar array in a common insulating body, and when it is desired to use a connector having so-called slotted plate contacts each having a plate portion having a slot open to one edge of the plate into which slot a conductor can be urged such that the slot walls grip the conductor and establish an electrical connection between the conductor and the contact.

2. Summary of the Invention

According to this invention, a shielded electrical cable comprises an outer layer of insulating material surrounding a signal conductor and an associated ground conductor and a common shielding layer in electrical contact with the ground conductor but separated from the signal conductor by an inner layer of insulating material surrounding the signal conductor, the signal and ground conductors extend in spaced parallel relationship in a common plane, each surrounded by an individual outer layer of insulating material, the two outer layers of insulating material being integrally formed with a web extending between the two outer layers of insulating material, the shielding layer extending about the inner layer of insulating material on the signal conductor, through the web, and about the ground conductor.

The cable of this invention has the advantage that the spacing between the signal and ground conductors can be set to accord with the spacing between the relevant contacts in a connector to be used to terminate the cable whereby a mass termination technique can be used without the operator having to rearrange the cable conductors.

Preferably the diameter of the outer layer of insulating material surrounding the ground conductor is substantially equal to the diameter of the inner layer of insulating material surrounding the signal conductor.

Such a choice of dimensions enables the use of slotted plate contacts having the same size slots for termination of the signal and ground conductors, thus facilitating assembly of a connector to be used to terminate the cable since identical contacts can be used for all conductors. For termination the outer layer of insulating material and the shielding layer are stripped from a length of the signal conductor, this leaving an insulated signal conductor and a ground conductor surrounded by the shielding layer and the outer layer of insulating material, of substantially equal diameter.

A composite cable can be formed from a plurality of cables according to this invention, arranged in side-by-side relationship, the cables being connected by an integrally formed web extending between the outer layers of insulating material of the cables.

Such a composite cable can be readily mass terminated with a minimum of pre-preparation using conventional techniques and a connector having a plurality of contacts with identical slotted plate contact portions, the conductors in the cable being spaced in accordance with the spacing of the associated contacts of the connector.

BRIEF DESCRIPTION OF THE INVENTION

An electrical cable according to the invention will now be described by way of example with reference to the drawing, in which:

FIG. 1 is an end view of the cable;

FIG. 2 is a sectional view through a signal conductor of the cable; and

FIG. 3 is a perspective view of an end portion of the cable prepared for termination, and of contacts for use in termination.

DETAILED DESCRIPTION OF THE INVENTION

As shown in FIGS. 1 and 2 the cable comprises a plurality of seven strand signal conductors 1 and a corresponding individually associated plurality of seven strand ground conductors 2.

Each signal conductor 1 is surrounded by an inner layer 3 of insulating plastic material, which is in turn surrounded by a shielding layer 4 formed, for example, of an aluminium foil. The shielding layer 4 is in turn surrounded by an outer layer 5 of insulating plastic material.

The signal and ground conductors 1 and 2 are alternately arranged in spaced parallel relationship in a planar array, the spacing between adjacent conductors being equal to the spacing between adjacent contacts in a connector to be used to terminate the cable (as illustrated in FIG. 3).

Each ground conductor 2 is surrounded by the shielding layer 4 which is in electrical contact therewith, the shielding layer 4 in turn being surrounded by an outer layer 6 of insulating plastic material.

The outer layer 5 of insulating material surrounding each signal conductor 1 and the outer layer 6 of insulating material surrounding the associated ground conductor 2 are joined by a web 7 through which the shielding layer 4 extends.

The outer layers 5 and 6 of insulating material and the web 7 are integrally formed and each pair of signal and ground conductors 1 and 2 is joined to the adjacent pair or pairs by a further web 8 of insulating material also integrally formed with the layers 5 and 6 and the web 7.

Thus, the shileding layer 4 of each pair of signal and ground conductors 1 and 2 serves to shield the signal conductor 1 thoughout its length, and can easily be terminated at a connector in a similar manner to the signal conductor 1 by means of the ground conductor 2 which is electrically connected thereto.

FIG. 3 shows an end portion of a cable as shown in FIGS. 1 and 2 prepared for termination by means of a connector (not shown in detail) having contacts with slotted plate portions 10 each having a slot 11 into which a conductor can be urged transversely of its axis. As shown, the outer layer 5 of insulating material and the shielding layer 4 have been removed from a length of the signal conductor 1 to leave the conductor 1 with the inner layer 3 of insulating material thereon substantially equal in diameter to the diameter of the ground conductor 2 with the surrounding shielding layer 4 and outer layer 6 of insulating material. The web 7 with the shielding layer 4 therein has also been removed from between the signal and ground conductors 1 and 2, as has the web 8 between adjacent pairs of associates signal and ground conductors 1 and 2.

The cable can thus be terminated using conventional mass termination apparatus (not shown) and using a connector having contacts with identical slotted plate contact portions 10 as shown.

The cable of this invention can be manufactured using known extrusion techniques which do not require detailed description herein.

What is claimed is:

1. A shielded electrical cable, comprising:

a plurality of signal conductors;

a sheath of insulating material surrounding each of the signal conductors defining insulated signal conductors;

a plurality of ground conductors, the insulated signal conductors and the ground conductors being alternately arranged in spaced parallel relationship as a planar array;

a layer of shielding material substantially surrounding and electrically engaging each of the ground conductors and defining shield-engaging ground conductors, said layer of shielding material extending to an adjacent one of the insulated signal conductors and substantially surrounding the adjacent one of the insulated signal conductors; and an outer layer of insulating material surrounding each of the shielded insulated signal conductors, each of the shield-engaging ground conductors, and the shielding material extending between adjacent signal conductors and ground conductors, the insulating material covering both sides of the layer of shielding material extending between adjacent signal conductors and ground conductors and defining a web.

2. A shielded electrical cable as set forth in claim 1, wherein the diameter of the outer layer of insulating material surrounding the ground conductors is substantially equal to the diameter of the insulated signal conductors.

3. A shielded electrical cable as set forth in claim 1, wherein web members of integrally-formed insulating material extend between the outer layers of insulating material.

4. A ribbon coax cable, comprising:

a plurality of coaxial cables, each of the coaxial cables including signal conductor means, insulation sheath means covering the signal conductor means and outer conductor means covering the insulation sheath means;

a plurality of ground conductor means, the plurality of coaxial cables and the ground conductor means being alternately arranged in spaced parallel relationship as a substantially planar array with a ground conductor means associated with a respective coaxial cable;

an outer layer of insulating material covering the coaxial cables and the ground conductor means thereby maintaining the coaxial cables and ground conductor means in ribbon form and defining web means between the respective coaxial cables and ground conductor means so that the coaxial cables and ground conductor means remain parallel and spaced with respect to each other;

electrical conductive means disposed between said outer layer of insulating material, electrically engaging respective outer conductor means of a coaxial cable, extending through said web means and electrically engaging an adjacent ground conductor means; and further web means of said layer of insulating material extending between ground conductor means and an adjacent one of the coaxial cables to isolate them from each other.

5. A ribbon coax cable as set forth in claim 4, wherein said outer conductor means and said electrical conductive means extending between respective coaxial means and ground conductive means is a continuous layer of electrical conductive material.

6. A ribbon coax cable as set forth in claim 5, wherein the continuous layer of electrical conductive material substantially surrounds the insulation sheath means and the respective ground conductor means.

7. A ribbon coax cable as set forth in claim 4, wherein the diameter of the outer layer of insulating material surrounding the ground conductor means is substantially equal to the diameter of the insulated signal conductor means.

8. A ribbon coax cable as set forth in claim 4, wherein the signal conductor means and the ground conductor means are stranded.

* * * * *